US007586383B2

(12) United States Patent
Juri et al.

(10) Patent No.: US 7,586,383 B2
(45) Date of Patent: Sep. 8, 2009

(54) AUTOMATIC TUNING OF MULTICAVITY FILTERS OF MICROWAVE SIGNALS

(75) Inventors: Bertelli Juri, Chiavenna (IT); Pirovano Fausto, Rho (IT)

(73) Assignee: Andrew Telecommunication Products S.r.l., (MI) (IT)

( * ) Notice: Subject to any disclaimer, the term of this patent is extended or adjusted under 35 U.S.C. 154(b) by 163 days.

(21) Appl. No.: 11/606,125

(22) Filed: Nov. 30, 2006

(65) Prior Publication Data

US 2007/0133443 A1 Jun. 14, 2007

(30) Foreign Application Priority Data

Dec. 6, 2005 (IT) ..... MI2005A002347

(51) Int. Cl.
*H03J 5/10* (2006.01)

(52) U.S. Cl. ..... 333/17.1; 333/232; 700/245

(58) Field of Classification Search ..... 333/17.1, 333/231–233, 235; 700/260, 261, 245; 81/57.11, 81/436; 173/2, 18; 334/8
See application file for complete search history.

(56) References Cited

U.S. PATENT DOCUMENTS

| | | | | |
|---|---|---|---|---|
| 4,385,279 | A * | 5/1983 | Meador | 333/235 |
| 6,057,748 | A * | 5/2000 | Hsing et al. | 333/224 |
| 6,147,577 | A * | 11/2000 | Cavey | 333/209 |
| 6,822,540 | B2 * | 11/2004 | Impio | 333/232 |
| 7,248,866 | B1 * | 7/2007 | Tsironis | 455/423 |
| 2003/0048148 | A1 * | 3/2003 | Humphreys et al. | 333/99 S |
| 2004/0239452 | A1 | 12/2004 | Bassali | |
| 2005/0094753 | A1 | 5/2005 | Burger | |

FOREIGN PATENT DOCUMENTS

JP 2002-2261510 A 9/2002

OTHER PUBLICATIONS

J. E. Reinhart et al., "Automated Process Cuts Filter Tuning Time From Hours to Minutes", Microwaves & RF, vol. 40, No. 6, Jun. 2001, pp. 103-104.

M. Yu, "A Fully Automated Filter Tuning Robot for Wireless Base Station Diplexers", Computer Aided Filter Tuning Workshop IMS 2003, IEEE/MTT International Microwave Symposium, Jun. 13, 2003, pp. 1-14.

"Robotic Tuning —RF Filters on the Fast Track", Stay Connected—The Radio Frequency Systems Bulletin, No. 3-2005, 2005, pp. 1-20.

P. Harscher et al., "Automated Filter Tuning Using Generalized Low-Pass Prototype Networks and Gradient-Based Parameter Extraction", IEEE Transactions on Microwave Theory and Techniques, IEEE Service Center, Piscataway, NJ, vol. 49, No. 12, Dec. 2001, p. 2533.

* cited by examiner

*Primary Examiner*—Robert Pascal
*Assistant Examiner*—Gerald Stevens
(74) *Attorney, Agent, or Firm*—Dickstein Shapiro LLP

(57) ABSTRACT

The system for the automatically tuning of multicavity filters of high frequency signals, by means of screws sticking out from the lid of the plate incorporating said cavities, comprises a robotized movement imparting subsystem SUB-1A, a measuring subsystem SUB-2M for the extraction of the transfer characteristic, a subsystem SUB-3C to compare said measured values to reference parameters, a subsystem SUB-4G for the generation of said reference parameters, and a subsystem SUB-5CO enslaved to said SUB-4G and SUB-1.

8 Claims, 7 Drawing Sheets

AUTOMATIC TUNING OF MULTICAVITY FILTERS OF MICROWAVE SIGNALS

BACKGROUND OF THE INVENTION

The present invention refers to the automatic tuning of multicavity filters of high frequency signals. More particularly the invention concerns a system for the automatic tuning of microwave filters by means of a Cartesian robot therefore without the intervention of human operators, each one of said filters substantially comprising a body in which resonant (in air and/or dielectrics) cavities are made, and tuning controlling means are provided which pass through and stickout of at least a plate and/or cover (lid) of said body and have generally the form of screws with or without nut.

STATE OF THE ART

The telecommunication industry demand of microwave devices that include filters, duplexers, multiplexers and the like, has exponentially increased in the latest years because of the expansion of radio link based communications that use mobile networks, such as GSM and UMTS networks.

In general these filters (in form of duplexer, triplexer and the like) have sections for the transmission (Tx) and for the reception (Rx) of microwave signals, generally associated to additional features like amplifiers, protections against lightnings, probes, etc.

These filters require an ultra-precise tuning in order to fulfill the customer specifications because of the mechanical tolerances proper of the process of realization.

Another factor (even more important) of modification of the characteristics of the filters is the assembly of a series of different components, made by human operators that can not be done in a repetitive way.

The present means for the tuning of said filters by human operator are heuristic and not repetitive, therefore skilled operators are required.

Furthermore, such procedures are time consuming and increase the cost of each unit.

In general the tuning process consists in introducing each screw one at a time inside each cavity in order to change its natural resonant frequency. Even a little change of this penetration can strongly affect the resonant frequency and the global performance of the system, so a fine sensitivity is required.

Significantly no-coded procedures are available; at the best of our knowledge neither methods nor systems of robotization of the tuning of multicavity filters are described in the technical literature or patents even if it should not be excluded possible attempts of unknown filter manufactures who however would have preferred to not publish their attempts also in view of their not-yet consolidated performances and reliability.

OBJECTS AND SUMMARY OF THE INVENTION

First object of the present invention is to provide an automatic system (i.e. without interventions of high-skilled human operators) for the automatic tuning of multicavity filters for microwave applications.

Another object is to provide an industrial robotized system capable to reduce production costs, shorten testing time and reduce assembly uncertainties.

These and other objects are reached with the aid of the present invention whose more notable features are recited in the claims at the end of this specification (to be also considered herewith incorporated)

In a preferred embodiment the system according to the invention comprises at least:

- a subsystem SUB-1A for the robotwise driving and control of all the regulation devices (OR);
- a subsystem SUB-2MI for measuring the real time frequency response of the device under test (DUT);
- a subsystem SUB-3C to compare the measured values in SUB-2MI, with reference parameters generated in SUB-4G;
- said subsystem SUB-4G that produces said parameters of reference; and
- a subsystem SUB-5CO, interlocked to SUB-4G, to control the devices included in SUB-1A and SUB-4AG.

BRIEF DESCRIPTION OF THE DRAWINGS

The different aspects and advantages of the invention will result more clearly from the description of the particular embodiments represented (for illustrative and not limiting purposes) in the accompanying drawings in which.

DETAILED DESCRIPTION OF THE EMBODIMENTS ILLUSTRATED IN THE DRAWINGS

Figure 1:
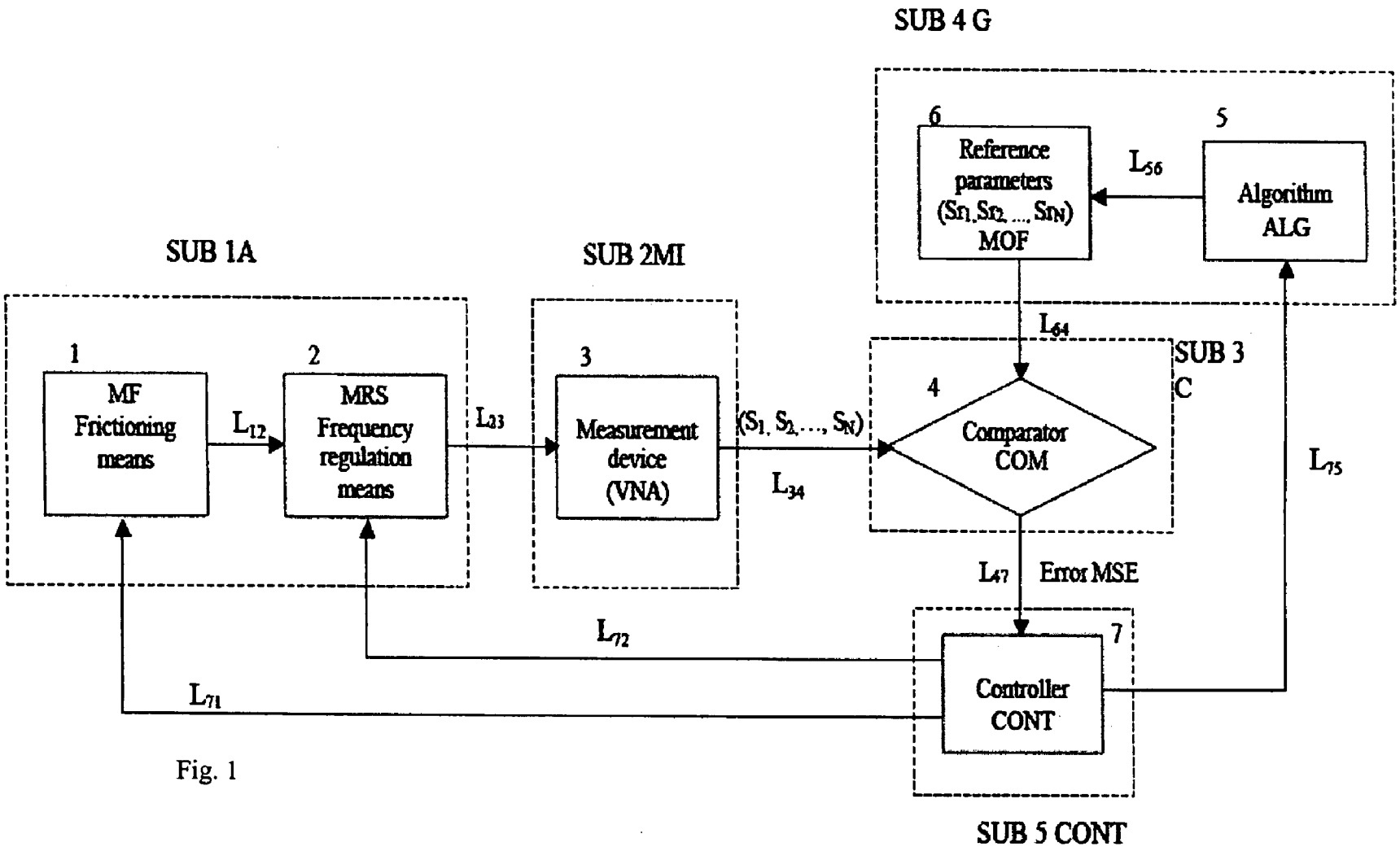
FIGS. 1 and 3 are block diagrams of the system.

FIG. 1 represents the system according to the invention including (preferably) five subsystems (that can be compacted and expanded):

First activation subsystem, SUB-1A substantially consists of:

1) Frictioning means MF (for instance associated to the nut of each screw V), in this case represented as external exagonal nuts MF1.

Figure 2:
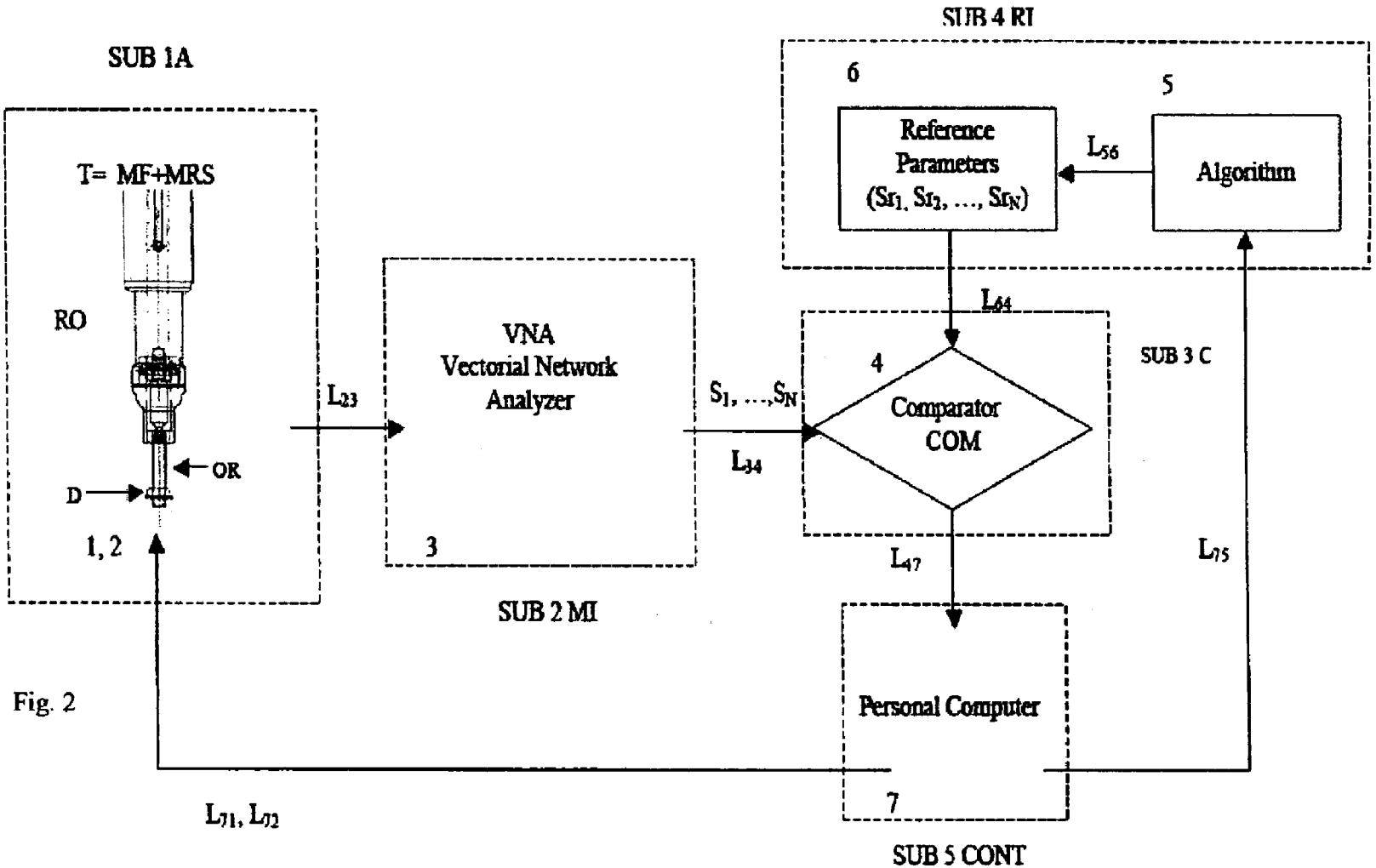
FIG. 2 is a block diagram that includes also schematic frontal views of said driving means (SUB-1A), of the measuring means included in subsystem SUB-2MI, and of the control subsystem SUB-5C.

2) means for the regulation of the parameters of the DUT, in this case a TORX-Type coaxial screw MRS2; said MF1 and MRS2 are activated by robot RO (FIG. 2).

Second SUB-2M comprises the measure instruments connected to said DUT to perform the real time data acquisition of the sensible parameters of the DUT. In this case the acquisition instrument is a vectorial network analyzer (VNA) that measures the scatter parameters of said DUT, S1, S2, Si, . . . , Sn, where the series i=1, . . . , n indicates the number of tuning elements.

Third subsystem SUB-3C consists of a comparator which compares the real-time measured scatter parameters S1, S2 . . . Si . . . Sn in SUB-2M to the scatter parameters (Sri) generated as reference in SUB-4Ri. This comparator (COM) yields the MSE (mean square error).

Fourth subsystem SUB-4Ri is made up of a block (5) of the Algorithm ALG which feeds block (6) generating the scatter parameters of reference (Sri) for each tuning element, stored in a static memory (MOF). These reference parameters are elaborated suitably by said algorithm (ALG) described later (called NewGiotto). The Sri are the parameters that will assure the best performance of the DUT.

Fifth subsystem SUB-SCO is a controller (CONT.7) able to manage all the data elaborating operations involved in the tuning procedure and able to control the robot movements. In synthesis, depending on the error signal MSE received as input (line L 4.7) the controller (7) pilots the movements of the frictioning devices MF-1 and of tuning devices MRS-2 (lines L71 and L72) which cause the real time variation Si (L12, L23, L34). The new calculated Si generate a new error function (L47) that closes the feedback loop. When the measured error MSE reaches its minimum value, the algorithm ALG interrupts and proceeds with the following element of regulation.

The controller CONT-7 can be realized with a lot of different technologies well known in the field of the automatic controls: meaningful examples are the controllers based on PLC (Programamble Logic Control), PAC (Programmable Automation Control), PXI (Module), PCI (Extension for Instrumentation), PC (Personal Computer) etc.

Figure 3:
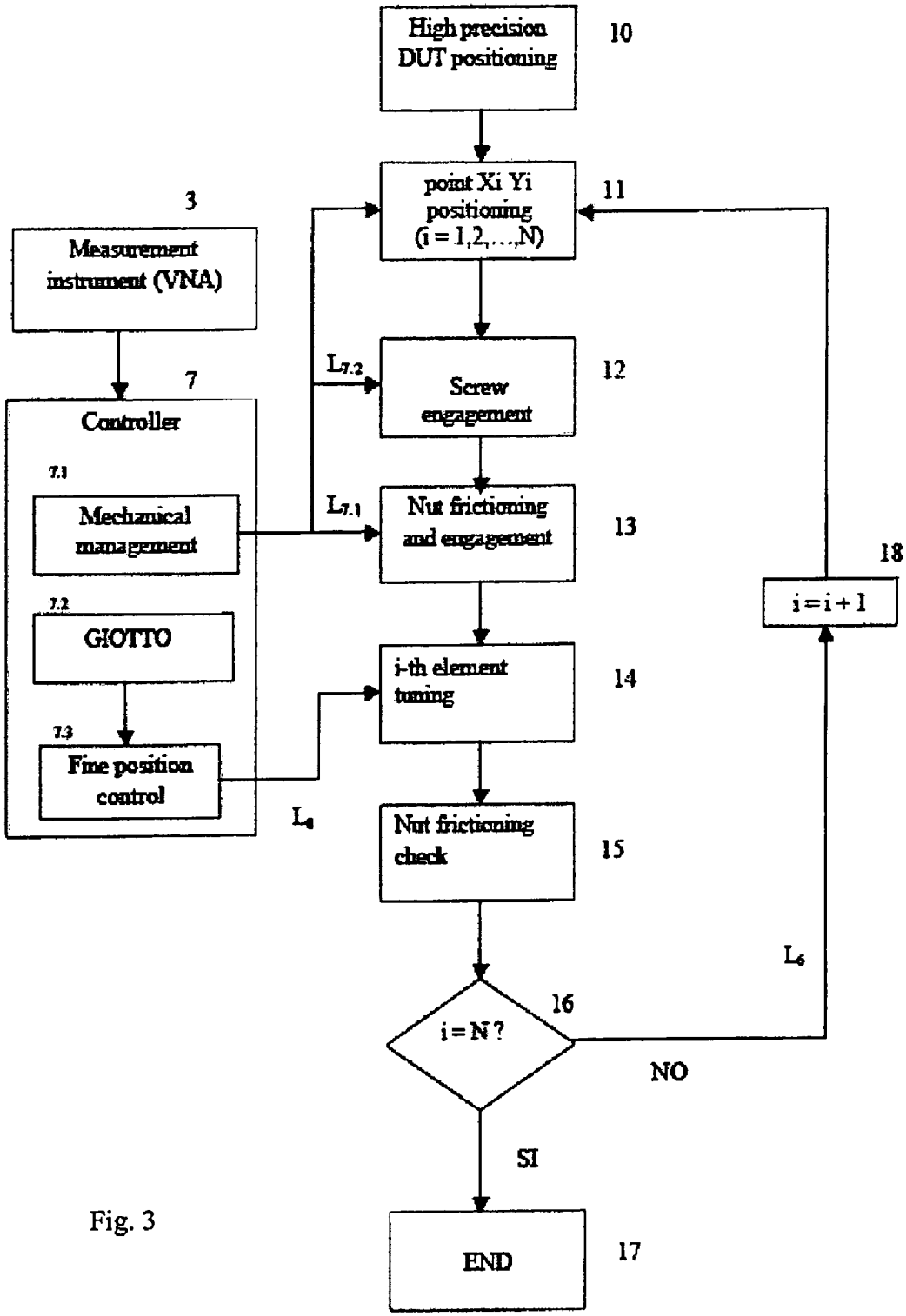

The operations (Workflow) of the system according to the invention are as in FIG. 3.

block 10 points out the operation of positioning the DUT on the relative fixed precision support (called as DIMA): even though generally this positioning is not manual, in the drawing no automatic feeder (f.i. belt conveyors) is represented.

block 11 points out the positioning of the head (T in FIG. 2) of the robot RO, on the points Xi, Yi corresponding to the Cartesian coordinates of the i-th organ of regulation OR, represented in FIG. 2.

block 12 shows the operation of the engagement of the regulation device OR (screw);

block 13 shows the operation of the engagement of the nut (D) associated with the i-th screw.

block 14 shows the tuning of one ORi through the regulation of its penetration inside its cavity (not represented) in the body of the filter. The level of this penetration is commanded by line L8 carrying the signal from the Controller 7 that performs two functions: 7.1 management of the mechanical organs that move each screw; 7.2 and 7.3, determination of the penetration with the aid to the algorithm "NewGiotto" (7.2) and the control of the fine positioning.

block 15 controls the friction of the nut Di associated to ORi.

block 16 checks the whole workflow: if every regulation device has been tuned, the procedure ends (block 17).

If in 16 i-th is strictly lower than N a cycle starts whereby through L6 and the increment block 18, the procedure restarts from block 11.

FIG. 2 schematically shows the subsystem SUB-2MI here preferably represented as a VNA (Vectorial Network Analyzer), and the subsystem SUB-5CO preferably represented by a Personal Computer.

Figure 4:
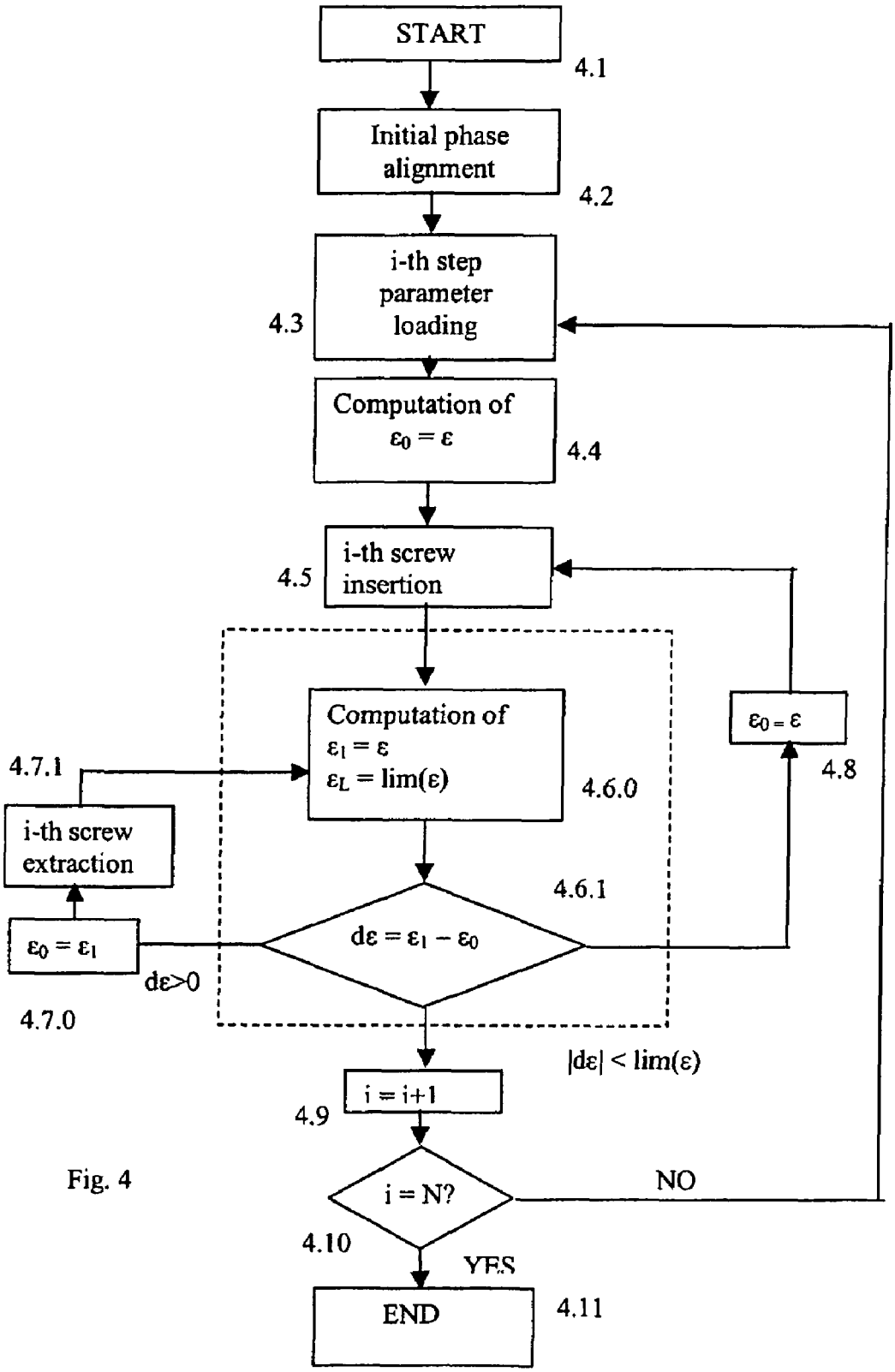
FIG. 4 illustrates the block diagram of the algorithm that governs the system.

FIG. 4 shows an embodiment of the control algorithm called "NewGiotto" (7.2 of FIG. 3) that substantially articulates in the following phases:

4.1 START: setting of DUT initial conditions; in the most significant case of a plate filter (closed by a lid) with regulation devices OR represented by screws, these are completely drawn out and of the cover (lid) stick out from the top of said lid. The procedure starts with the loading from an appropriate database of the acquired parameters Sri for every tuning devices ORi.

4.2 Alignment of the phase of the measured signal with the phase of the reference signal: the differences of phase between the reference device GU (Golden Unit) and the DUT are compensated by optimizing numerically a quantity L in the so said expression MSE=[phase (Sri)−phase (S0)* exp. (j2n β L)], where Sri is acquired by the said GU and stored in the data base, SO is the scatter matrix of the DUT and L represents the length of an ideal line determined by means of optimization. The minimization of the phase errors introduced in the DUT in comparison to the GU is fundamental to get a good final result of the general procedure.

4.3 Loading. After having prepared DUT as in 4.1 and minimized the initial error as in 4.2, in this block (4.3) the software loads the parameters of reference Sri relating to the i-th screw, depending on the tuning sequence established during the acquisition phase.

4.4 Calculation of $\epsilon_0=\epsilon$. Here takes place the evaluation of the error ($\epsilon$) between the real time measured scatter parameters of the DUT and the respective scatter parameters of the golden unit, where so is the initial error, $\epsilon$ is the current error and $\epsilon_0-\epsilon$=MSE (sin. (phase Sri), sin phase (Si). The application of the function sine (sin) to the signal phase has the scope to filter the most rapid variation fronts of the measure and to normalize it between −1 and 1.

4.5 i-th screw insertion of a predetermined quantity.

4.6 Calculation $\epsilon_1=\epsilon$. This block 4.6 consists of two subblock 4.6.0 and 4.6.1. In the first subbblock two functions i.e. error $\epsilon_1$ and $\epsilon_L$=lim ($\epsilon$) are calculated. The second sublock 4.6.1 estimates the difference of $\epsilon$, i.e. $\epsilon=\epsilon_0$ (difference between initial error go and final error $\epsilon_1$). When d$\epsilon$ is minor than 0, we go over to block 4.8. If on the contrary is higher than 0 (d$\epsilon$>0) we go to block 4.7. If the absolute value of d$\epsilon$ é lower than $\epsilon_L$ (calculated in block 4.6.0) we go to block 4.9. In other words, in block 4.6.0 three values are calculated d$\epsilon$>0, d$\epsilon$<0 and the absolute value $\epsilon_L$=lim ($\epsilon$).

4.7 Assignment.

Here the value $\epsilon_1$ is assigned to $\epsilon_0$ ($\epsilon_1=\epsilon_0$).

4.8 Assignment bis.

Here again the value $\epsilon_1$ is assigned to $\epsilon_0$. Briefly, after moving the i-th screw the error measured is compared to the previous error: while the actual error decreases, the screw will be further inserted; otherwise, the screw will be positioned back in order to minimize the actual measured error.

4.9 Passage to the tuning device, i.e. if i-th device ORi is in optimal position (the measure is minimal) we go over to the tuning of the next device.

4.10 When every tuning devices (screws) has been properly positioned so that the measured error at each step of the procedure is minimum, the workflow finishes.

Figure 5:
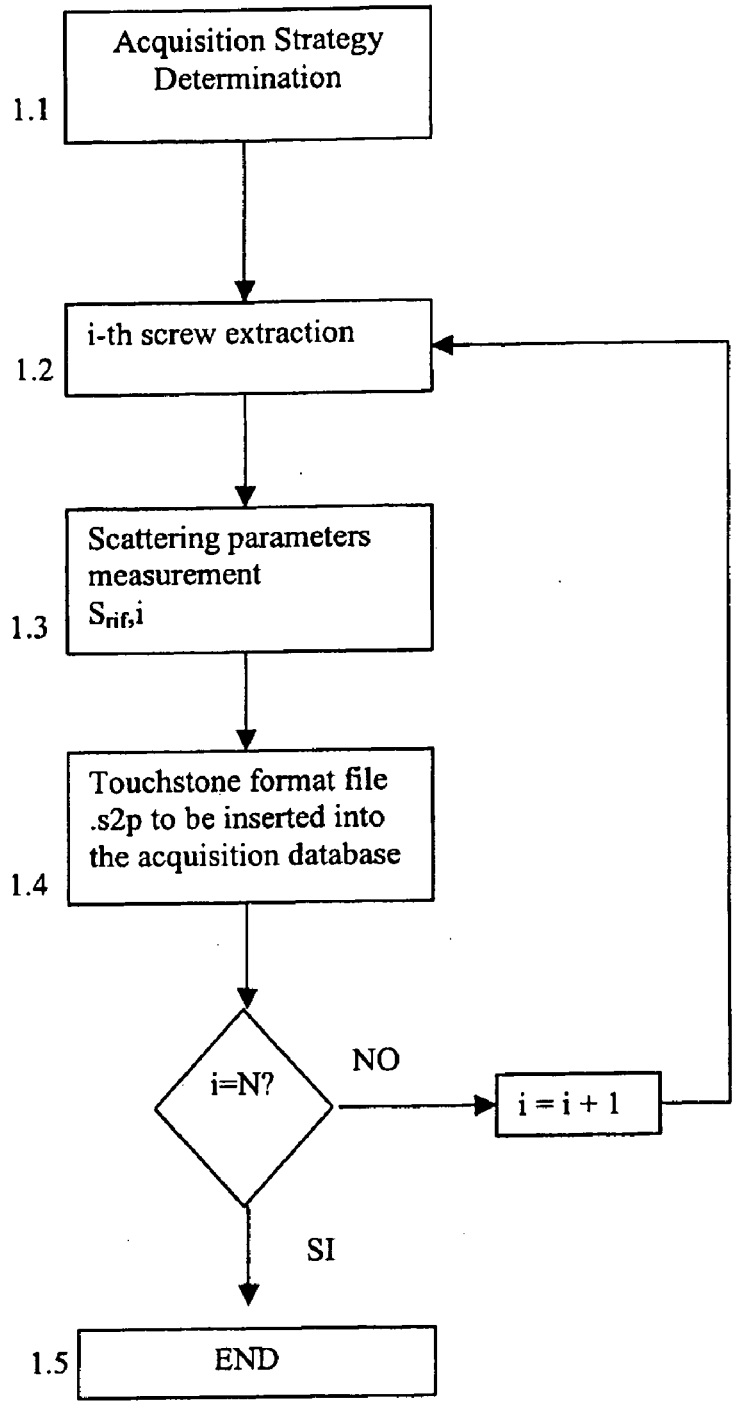
FIG. 5 describes the methodology of generation of the reference parameters Sri (FIG. 1) drawn by a reference filter GU (Golden Unit)

FIG. 5 shows the acquisition of the data Sri from the reference unit (GU). Note that the hereby defined Golden Unit (GU) is a perfectly tuned device.

The procedure is the following:

1.1 Determination of a strategy of acquisition (as in FIG. 1 SUB-4).

Based on the typology of the filters that form the system under examination, it is necessary to establish a sequence of ordered extraction of the elements of regulation. Such sequence doesn't have to alter the information of the system at the i-th step. Typically the determination of a correct and consistent sequence is a heuristic trial that strongly depends on the complexity of the system. In practice this acquisition is based on the extraction of one element of regulation (OR) at a time and on the measurement of the corresponding parameters of scatter.

1.2 Extraction of the i-th element of regulation (i=1, 2 . . . N) according to the established sequence in 1.1.

1.3 Measure of the parameters of scatter of the device and acquisition by means of a VNA (Vectorial Network Analyzer).

1.4 Transmission of the measured parameters to the controller (CONT), in this case Integrated in a PC.

Creation of a static file to store the scatter parameters.

1.5 End: when all the elements of regulation have been drawn out and the relative parameters have been acquired (that is i=N), the procedure ends.

Figure 6:
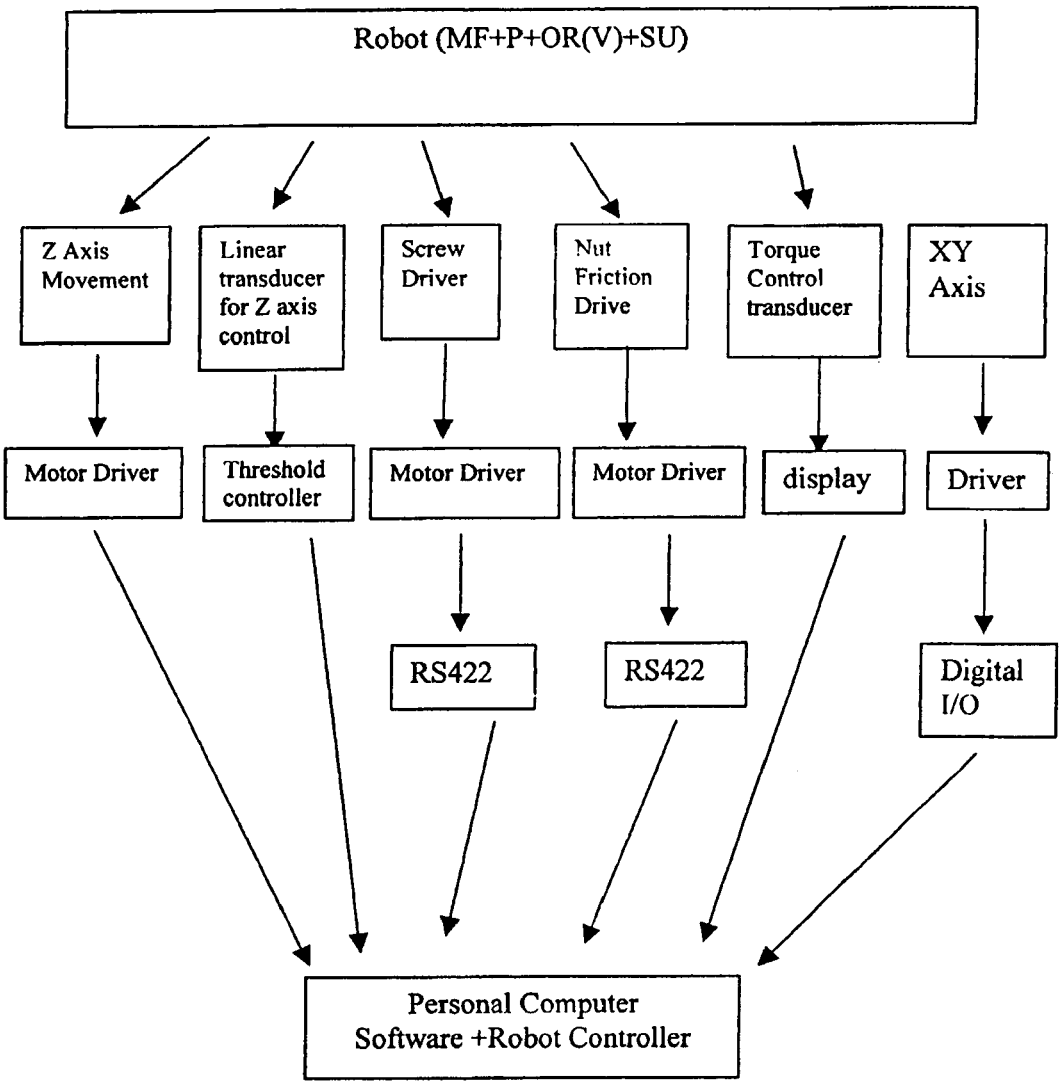
FIG. 6 is a schematic representation of the architecture of the system.

In FIG. 6 a schematic but effective layout of the general architecture of the system is presented, in which INT is a framework containing the frictioning device MF that can be moved vertically along Z axis (Z) in order to engage the tuning element OR (screw) sticking out from the cover (P) of the filter (F) mounted on a support (SU). The numbers from 1 to 6 describe the functional lines and the related means.

Line 1 (L1) refers to the vertical movement of the robot's head MF, fi. composed of two concentric screwdrivers. Line 1 has a motor M1 which acts on a power device DAP and a positioner whose positions are translated in digital signals 1/0 and stored in the PC via line 1'. Line 2 controls the pressure of the screwdrivers on the tuning element by means of a linear transductor (TZTG), along axis Z by grain head, a threshold switch (CTRL) and a communication bus with the controller (VS02), with line 2' connecting the relevant data to the PC. Line 3 represents the screwing process (V) of grain (G) involving a position P3 which reports to the PC its steps through line 3'.

L4 represents the screwing of nut D and has (as line 3) a positioner P4 and the relevant connection 4' to PC. Both the outputs of positioners P2 and P4 may be connected to a A/D converter.

Line 5 acts as line 2 and concerns the winding of nut D; to shows a transductor TSD and a visualizer VS5 whose signals are transferred to the PC. Finally on Line 6 are indicated the movements of the control means in the planar directions X-Y and the positioner P6 which is connected to the PC but receives also the safety management data.

Figure 7:
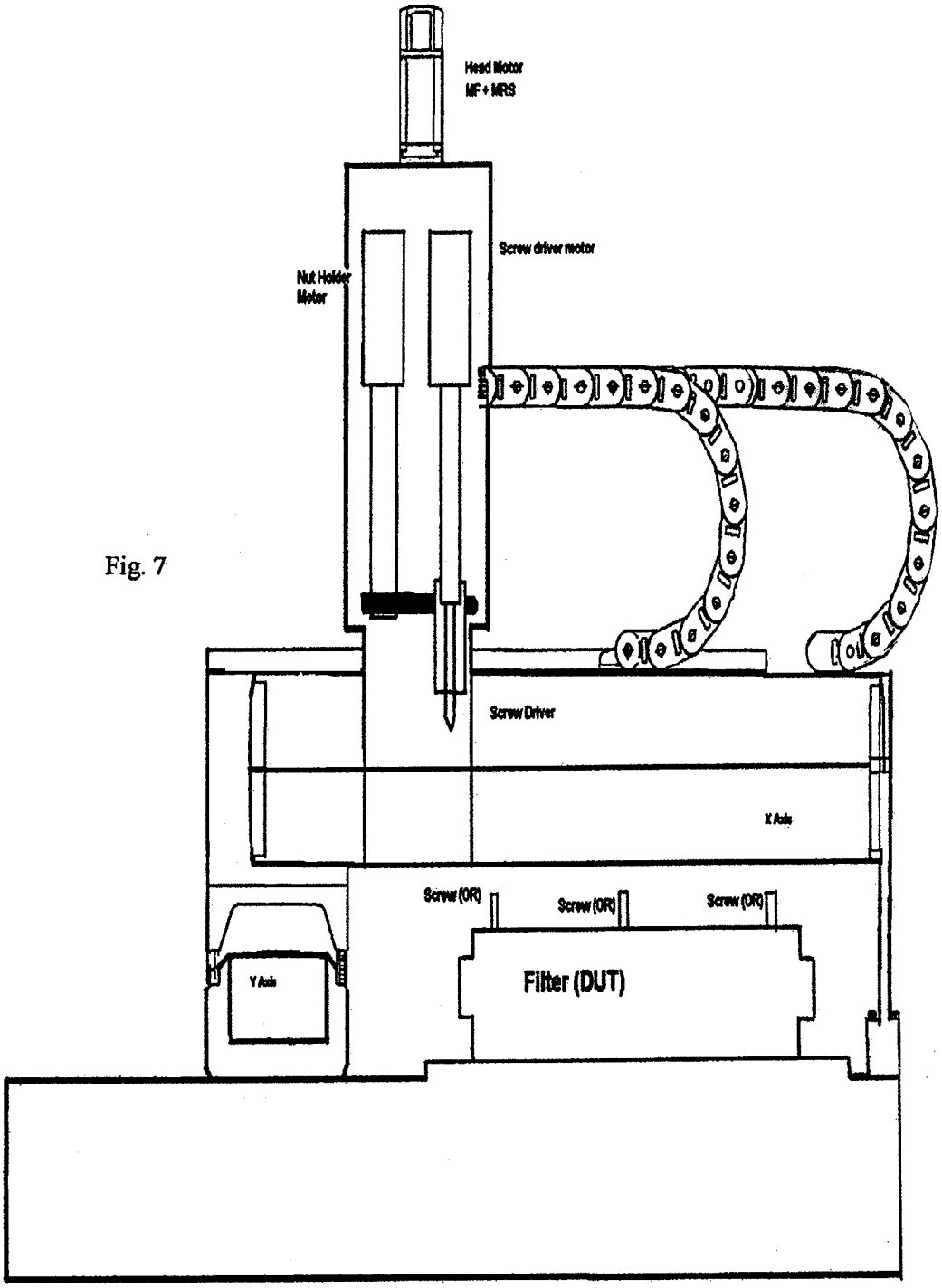
FIG. 7 is a partial frontal view of a preferred apparatus to embody the system according to the invention.

FIG. 7 (equipment frontal partial view) shows a preferred implementation essentially comprising the head of the equipment consisting basically of a principal vertical support (head, T) that can carry all the above described means such as MF and MRS (FIG. 2) the control means OR (coaxial screwdrivers), the vertical movement means Z (complexe straps CC) and all the devices thereto associated (fi. the motor M1, positioners P1, P3, P4 and trasductors TZTG, TSD).

Under the head T, are placed the carrier X-Y for the movements along axis X(20) and Y(21), the support SU of the filter closed by upper lid 23, out of which stick the screws (OR) on which are applied the mechanical means for the regulation of their penetration. As the screws are generally aligned on horizontal lines (X) but offset on line(Y), the control means (screwdrivers) are moved from one screw to the other in the direction X and at the end of each line are moved on the successive line on the axis Y. This is one of the most simple movements however it has the inconvenience of the necessity to adapt the strokes X-Y at the dimensionally different structures of the filters. To avoid such adaptations, optical lectures (of the photo-, TV-types) are provided to adapt automatically the strockes of the friction-, and-regulation means to the characteristic structures of the filters.

For illustrative clarity scruple the present invention has been described with reference to the embodiments represented in the accompanying drawings. It is however understood that said invention is susceptible of all variations, enhancements, substitutions, additions and the like which, being in the reach of the hand of any skilled person, are to be considered as comprised in the scope and spirit of said invention.

For example, some of the subsystems described in FIG. 1 and in FIG. 2 can be integrated and combined together. Typically SUB3, SUB4, SUB5 can be compacted or integrated into one single PC.

Therefore the present system must the appreciated also for its characteristics of high flexibility and reliability.

What is claimed is:

1. A system to automatically tune multicavity filters of high frequency (HF) signals, comprising:

at least one filter body with a plate which includes said cavities and is crossed by metallic tuning screws having heads sticking out of said plate and stems penetrating into one of said cavities, said system including:

at least one arm for coupling and moving said tuning screws to adjust the resonant frequency of each corresponding cavity;

a subsystem (SUB-1A) of driving and robotized movement of said screws as well for the regulation of the entity of their penetration inside the cavity, consisting of at least one frictioning device (MF-1) and at least one fine tuning regulation device (MRS-2);

a measuring subsystem (SUB-2MI) for the real time measurement of scatter parameters S1, S2 . . . Si, . . . SN (N being the number of tuning screws), the measuring subsystem comprising a VNA (Vectorial Network Analyzer), adapted to measure the real-time frequency response of an under-test filter (DUT);

a subsystem SUB-3C for comparing the values S1, S2 . . . Si, . . . SN measured by SUB-2MI with parameters of reference Sri generated by a reference parameter-generating subsystem SUB-4G;

and a subsystem (SUB-5) comprising a controller (CONT) enslaved to SUB-4G for controlling the means included in SUB-1A and SUB-5, wherein the subsystem SUB-3C compares the real-time frequency response from SUB-2MI with a reference frequency response recorded in a non-volatile memory of SUB-4G and feeds the results of the comparison as MSE (Mean Square Errors) to the controller (CONT) of SUB-5.

2. The system according to claim 1, in which the robotized subsystem (SUB-1A) includes two coaxial arms.

3. The system according to claim 1, in which the subsystem SUB-5 receives said MSE and controls the subsystems SUB-1A and SUB-4G.

4. The system according to claim 1, in which the subsystem SUB-4G includes a reference parameter generator (6) and an algorithm generator (5).

5. The system according to claim 4, in which said reference parameter generator (6) includes at least:

a measurement tool for measuring reference parameters Sr1, Sr2 . . . Sr . . . SrN from a perfectly-tuned reference unit; and a storage device for storing the measured reference parameters Sr1, Sr2 . . . Sri . . . SrN.

6. The system according to claim 1, wherein said at least one frictioning device is a screw driver.

7. The system according to claim 1, wherein a single arm is used to couple and move all of said tuning screws.

8. A system to automatically tune multicavity filters of high frequency (HF) signals, comprising:

at least one filter body with a plate which includes said cavities and is crossed by metallic tuning screws having heads sticking out of said plate and stems penetrating into one of said cavities, said system including:

at least one arm for coupling and moving said tuning screws to adjust the resonant frequency of each corresponding cavity;

a subsystem (SUB-1A) of driving and robotized movement of said screws as well for the regulation of the entity of their penetration inside the cavity, consisting of at least one frictioning device (MF-1) and at least one fine tuning regulation device (MRS-2);

a measuring subsystem (SUB-2MI) for the real time measurement of scatter parameters S1, S2 . . . Si, . . . SN (N being the number of tuning screws);

a subsystem SUB-3C for comparing the values S1, S2 . . . Si, . . . SN measured by SUB-2MI with parameters of reference Sri generated by a reference parameter-generating subsystem SUB-4G, the reference parameter-generating subsystem SUB-4G comprising a reference parameter generator (6) and an algorithm generator (5) comprising a processor for loading the scatter parameters S1, S2 . . . Si . . . SN measured by SUB-2MI and determining a difference ($\delta_\epsilon$) between a current measurement of one of said scatter parameters (ϵ1) and a prior measurement of one of said scatter parameters (ϵ0) while a corresponding tuning screw is being inserted, wherein when $\delta_\epsilon$is less than 0 the tuning screw is inserted and when $\delta_\epsilon$is less than a threshold (lim ϵ), insertion of the corresponding tuning screw is stopped;

and a subsystem (SUB-5) comprising a controller (CONT) enslaved to SUB-4G for controlling the means included in SUB-1A and SUB-5.

* * * * *